US008454718B2

(12) United States Patent
Buchmann et al.

(10) Patent No.: US 8,454,718 B2
(45) Date of Patent: Jun. 4, 2013

(54) WORKING VEHICLE HAVING COOLING SYSTEM WITH SUCTION DEVICE

(75) Inventors: Juergen Buchmann, Duisburg (DE); Dean E. Davis, Troy, OH (US); Derek M. Gamertsfelder, St. Marys, OH (US); Jason R. Kremer, New Bremen, OH (US); Donald E. Luebrecht, Ft. Jennings, OH (US); Joerg Nellen, Moers (DE); Nicholas J. Stein, Celina, OH (US)

(73) Assignee: Crown Equipment Corporation, New Bremen, OH (US)

( * ) Notice: Subject to any disclaimer, the term of this patent is extended or adjusted under 35 U.S.C. 154(b) by 505 days.

(21) Appl. No.: 12/708,625

(22) Filed: Feb. 19, 2010

(65) Prior Publication Data

US 2010/0242866 A1 Sep. 30, 2010

Related U.S. Application Data

(60) Provisional application No. 61/163,584, filed on Mar. 26, 2009, provisional application No. 61/163,578, filed on Mar. 26, 2009.

(51) Int. Cl.
*B01D 50/00* (2006.01)

(52) U.S. Cl.
USPC ..... 55/385.3; 55/393; 55/400; 55/492; 55/505; 55/524

(58) Field of Classification Search
USPC ..... 55/385.3, 393, 400, 320, 327, 336, 55/486, 492–495, 505, 529; 123/41.49, 198 E; 165/104.19
See application file for complete search history.

(56) References Cited

U.S. PATENT DOCUMENTS

| | | | |
|---|---|---|---|
| 3,155,473 | A | 11/1964 | McNeil |
| 3,487,623 | A | 1/1970 | Easter |
| 3,565,203 | A | 2/1971 | Ashton |

(Continued)

FOREIGN PATENT DOCUMENTS

| | | | |
|---|---|---|---|
| DE | 102004059701 | A1 | 6/2006 |
| EP | 0 481 203 | A1 | 4/1992 |

(Continued)

OTHER PUBLICATIONS

U.S. Appl. No. 12/708,574, filed Feb. 19, 2010 entitled "Working Vehicle Having Cooling System".

(Continued)

*Primary Examiner* — Jason M Greene
*Assistant Examiner* — Karla Hawkins
(74) *Attorney, Agent, or Firm* — Stevens & Showalter LLP

(57) ABSTRACT

A work vehicle is provided comprising: a main frame including an engine compartment; an engine located in the engine compartment; and a cooling system comprising a rotating fan apparatus and a cooling assembly. The cooling assembly may comprise a heat exchanger for transferring energy in the form of heat from a coolant fluid to air and a filter apparatus positioned adjacent an engine-compartment side of the heat exchanger. The air may be moved through the heat exchanger by the fan apparatus. The filter apparatus may filter the air before the air passes through the heat exchanger. The filter apparatus may comprise filter structure and a suction device for removing debris from the filter structure. The suction device preferably expels the debris outside of the engine compartment.

19 Claims, 11 Drawing Sheets

U.S. PATENT DOCUMENTS 3,630,003 A 12/1971 Ashton
3,636,684 A 1/1972 Vogelaar et al.
3,664,129 A 5/1972 Schwab
3,837,149 A * 9/1974 West et al. ..... 55/282.5
4,060,960 A 12/1977 Hengen et al.
4,092,942 A * 6/1978 Kurohiji et al. ..... 114/222
4,121,683 A 10/1978 Kohriyama
4,153,436 A 5/1979 Cozine et al.
4,233,040 A 11/1980 Vogelaar et al.
4,299,603 A 11/1981 Friesen
4,339,014 A 7/1982 Berth et al.
4,371,047 A 2/1983 Hale et al.
4,397,348 A 8/1983 Klem
4,439,218 A 3/1984 Priepke et al.
4,443,236 A 4/1984 Peiler
4,514,201 A 4/1985 Brown
4,531,574 A 7/1985 Hoch
4,539,943 A 9/1985 Tsuchikawa et al.
4,542,785 A 9/1985 Bagnall et al.
4,546,742 A 10/1985 Sturges
4,592,437 A 6/1986 Holm et al.
4,757,858 A 7/1988 Miller et al.
4,874,411 A 10/1989 Snauwaert et al.
4,906,262 A 3/1990 Nelson et al.
4,913,102 A 4/1990 Ohmura et al.
4,969,533 A 11/1990 Holm et al.
4,971,525 A 11/1990 Nakayoshi et al.
5,088,960 A 2/1992 Stickler et al.
5,183,487 A 2/1993 Lodico et al.
5,224,446 A 7/1993 Okita et al.
5,466,189 A 11/1995 Deutsch et al.
5,531,190 A 7/1996 Mork
5,595,537 A 1/1997 Jungemann et al.
5,676,197 A 10/1997 Diebold et al.
5,735,337 A 4/1998 Edwards
5,839,279 A 11/1998 Moriya et al.
5,851,441 A 12/1998 Kato et al.
5,944,603 A 8/1999 Guinn et al.
5,960,748 A 10/1999 Lewis
5,960,899 A 10/1999 Roach
5,971,068 A 10/1999 Ochiai et al.
6,010,309 A 1/2000 Takamura et al.
6,076,488 A 6/2000 Yamagishi
6,105,660 A 8/2000 Knurr
6,126,079 A 10/2000 Shoemaker
6,131,681 A 10/2000 Nelson et al.
6,178,928 B1 1/2001 Corriveau
6,193,772 B1 2/2001 Wiefel
6,248,145 B1 6/2001 Radke
6,298,906 B1 10/2001 Vize
6,308,795 B2 10/2001 Sewell
6,349,882 B1 2/2002 Kita et al.
6,432,152 B2 8/2002 Frerich
6,468,153 B2 10/2002 Sheidler et al.
6,481,388 B1 11/2002 Yamamoto
6,514,303 B2 2/2003 Lukac et al.
6,616,411 B2 9/2003 Sheidler et al.
6,634,448 B2 10/2003 Bland
6,796,897 B1 9/2004 Lovett et al.
6,817,404 B2 11/2004 Frana-Guthrie et al.
6,823,955 B2 11/2004 Hall et al.
6,959,671 B2 11/2005 Nakagawa et al.
6,974,487 B2 12/2005 Twiefel
7,204,329 B2 * 4/2007 Pfohl et al. ..... 180/68.3
7,401,672 B2 7/2008 Kurtz, Jr. et al.
7,481,287 B2 1/2009 Madson et al.
7,503,380 B2 3/2009 Jakob
8,256,551 B2 9/2012 Entriken et al.
2005/0051308 A1 3/2005 Jakob
2005/0217907 A1 10/2005 Madson et al.
2006/0283157 A1 12/2006 Keys, II et al.
2007/0056786 A1 3/2007 Fukazawa et al.
2007/0261908 A1 11/2007 Berger et al.
2008/0169142 A1 7/2008 Kinoshita et al.

FOREIGN PATENT DOCUMENTS

EP 0 667 447 A1 8/1995
EP 1 493 905 A1 1/2005
JP 52138151 U 10/1977
JP 53099434 U 8/1978
JP 57083229 U 5/1982
JP 60170029 U 11/1985
JP 61058631 U 4/1986
JP 4100918 U 9/1992
JP 08 049540 2/1996
JP 09 009760 1/1997
JP 2001263063 A 9/2001
JP 2003314283 A 11/2003

OTHER PUBLICATIONS

Application No. PCT/US10/24681, filed Feb. 19, 2010 entitled "Working Vehicle Having Cooling System".

Application No. PCT/US10/24714, filed Feb. 19, 2010 entitled "Working Vehicle Having Cooling System With Suction Device".

J. Matray; International Search Report and Written Opinion of the International Searching Authority; International Application No. PCT/US2010/024681; Jun. 21, 2010; European Patent Office.

Nora Lindner; International Preliminary Report on Patentability and and Written Opinion of the International Searching Authority; International Application No. PCT/US2010/024681; Oct. 6, 2011; International Bureau of WIPO; Geneva Switzerland.

Lingfei Bai; International Preliminary Report on Patentability and and Written Opinion of the International Searching Authority; International Application No. PCT/US2010/024714; Oct. 6, 2011; International Bureau of WIPO; Geneva Switzerland.

J. Matray; International Search Report and Written Opinion of the International Searching Authority; International Application No. PCT/US2010/024714; Apr. 28, 2010; European Patent Office.

Brian Swenson; Non-final Office Action; U.S. Appl. No. 12/708,574; Oct. 1, 2012; United States Patent and Trademark Office; Alexandria, VA.

* cited by examiner

WORKING VEHICLE HAVING COOLING SYSTEM WITH SUCTION DEVICE

CROSS REFERENCE TO RELATED APPLICATIONS

This application claims the benefit of U.S. Provisional Patent Application Ser. No. 61/163,584, filed Mar. 26, 2009, entitled "WORKING VEHICLE HAVING COOLING SYSTEM WITH SUCTION DEVICE," and U.S. Provisional Patent Application Ser. No. 61/163,578, filed Mar. 26, 2009, entitled "WORKING VEHICLE HAVING COOLING SYSTEM," the entire disclosures of each of which are hereby incorporated by reference herein. This application is related to International Application Ser. No. PCT/US10/24714, filed concurrently herewith, and entitled "WORKING VEHICLE HAVING COOLING SYSTEM WITH SUCTION DEVICE," the entire disclosure of which is hereby incorporated by reference herein. This application is related to U.S. application Ser. No. 12/708,574, filed concurrently herewith, and entitled "WORKING VEHICLE HAVING COOLING SYSTEM," the entire disclosure of which is hereby incorporated by reference herein.

BACKGROUND OF THE INVENTION

The present invention relates in general to working vehicles, and more particularly, to cooling systems in working vehicles.

U.S. Pat. No. 3,837,149 discloses a combine having a rotating drum-type screen or air filter 84. The screen 84 is rotated slowly via a belt 98. The screen 84 is positioned in front of a fan 50. An L-shaped vacuum chamber 132 is mounted adjacent to the screen. A conduit 144 extends from a leg 136 of the chamber 132 to a fan shroud 46 so as to create a partial vacuum in the vacuum chamber 132. The screen 84 is located outside of an engine enclosure 22. However, material removed from the screen and moved through the vacuum chamber is believed to pass into the engine compartment.

U.S. Pat. No. 5,466,189 discloses a self-cleaning device for filtering air in a harvester comprising a rotary screen 76 and an air housing structure 100. The structure 100 is connected to a source of positive air pressure. The housing structure 100 provides a differential pressure across the screen 76 for removing lint and the like from the screen.

SUMMARY OF THE INVENTION

In accordance with a first aspect of the present invention, a work vehicle is provided comprising: a main frame including an engine compartment; an engine located in the engine compartment; and a cooling system comprising a rotating fan apparatus and a cooling assembly. The cooling assembly may comprise a heat exchanger for transferring energy in the form of heat from a coolant fluid to air and a filter apparatus positioned adjacent an engine-compartment side of the heat exchanger. The air may be moved through the heat exchanger by the fan apparatus. The filter apparatus may filter the air before the air passes through the heat exchanger. The filter apparatus may comprise filter structure and a suction device for removing debris from the filter structure. The suction device preferably expels the debris outside of the engine compartment.

The filter structure may comprise a support structure and a filter element. The support structure may comprise an inlet shroud and a mounting element coupled to the inlet shroud.

The filter structure may further comprise a motor coupled to the mounting element and a gear coupled to the motor.

The filter element may comprise a screen mounted to the mounting element and a ring gear associated with the screen. The motor gear engages the ring gear such that rotation of the motor effects rotation of the filter element.

The suction device may comprise a suction arm positioned adjacent the screen and a suction duct. The suction duct communicates with the suction arm and a fan shroud positioned adjacent a side of the heat exchanger opposite the engine-compartment side. The fan apparatus draws air through the suction duct and the suction arm such that debris is removed from the screen and moved through the suction arm and the suction duct into the fan shroud so as to be deposited outside of the engine compartment.

The cooling assembly may further comprise the fan shroud and connecting structure to couple the inlet shroud and the fan shroud together with the heat exchanger positioned between the inlet shroud and the fan shroud.

The cooling assembly may further comprise a first seal structure located between the heat exchanger and the inlet shroud so as to seal an interface between the heat exchanger and the inlet shroud.

The cooling assembly may further comprise a second seal structure located between the heat exchanger and the fan shroud so as to seal an interface between the heat exchanger and the fan shroud.

The support structure may further comprise a filter seal structure located between the inlet shroud and the mounting element so as to seal an interface between the inlet shroud and the mounting element.

The filter element may further comprise a brush seal located along an outer periphery of the screen so as to seal an interface between the screen and the mounting element.

In accordance with a second aspect of the present invention, a cooling assembly is provided for use in a work vehicle. The cooling assembly may comprise a heat exchanger for transferring energy in the form of heat from a coolant fluid to air passing through the heat exchanger, filter apparatus positioned adjacent a first side of the heat exchanger to filter the air before the air passes through the heat exchanger; a fan shroud positioned adjacent a second side of the heat exchanger opposite the first side; and connecting structure. The filter apparatus may comprise filter structure and a suction device for removing debris from the filter structure. The connecting structure may couple the filter structure and the fan shroud together with the heat exchanger positioned between the filter structure and the fan shroud, thereby forming a cooling assembly capable of being subsequently mounted into a work vehicle.

The filter structure may comprise a support structure and a filter element.

The support structure may comprise an inlet shroud and a mounting element coupled to the inlet shroud.

The filter structure may further comprise a motor coupled to the mounting element and a gear coupled to the motor. The filter element may comprise a screen mounted to the mounting element and a ring gear associated with the screen. The motor gear may engage the ring gear such that rotation of the motor effects rotation of the filter element.

The suction device may comprise a suction arm positioned adjacent the screen and a suction duct communicating with the suction arm and the fan shroud. A fan apparatus may draw air through the suction duct and the suction arm such that debris is removed from the screen and moved through the suction arm and the suction duct into the fan shroud.

BRIEF DESCRIPTION OF THE SEVERAL VIEWS OF THE DRAWINGS

The following description of the preferred embodiments of the present invention can be best understood when read in conjunction with the following drawings, where like structure is indicated with like reference numerals, and in which.

DETAILED DESCRIPTION OF THE INVENTION

In the following description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
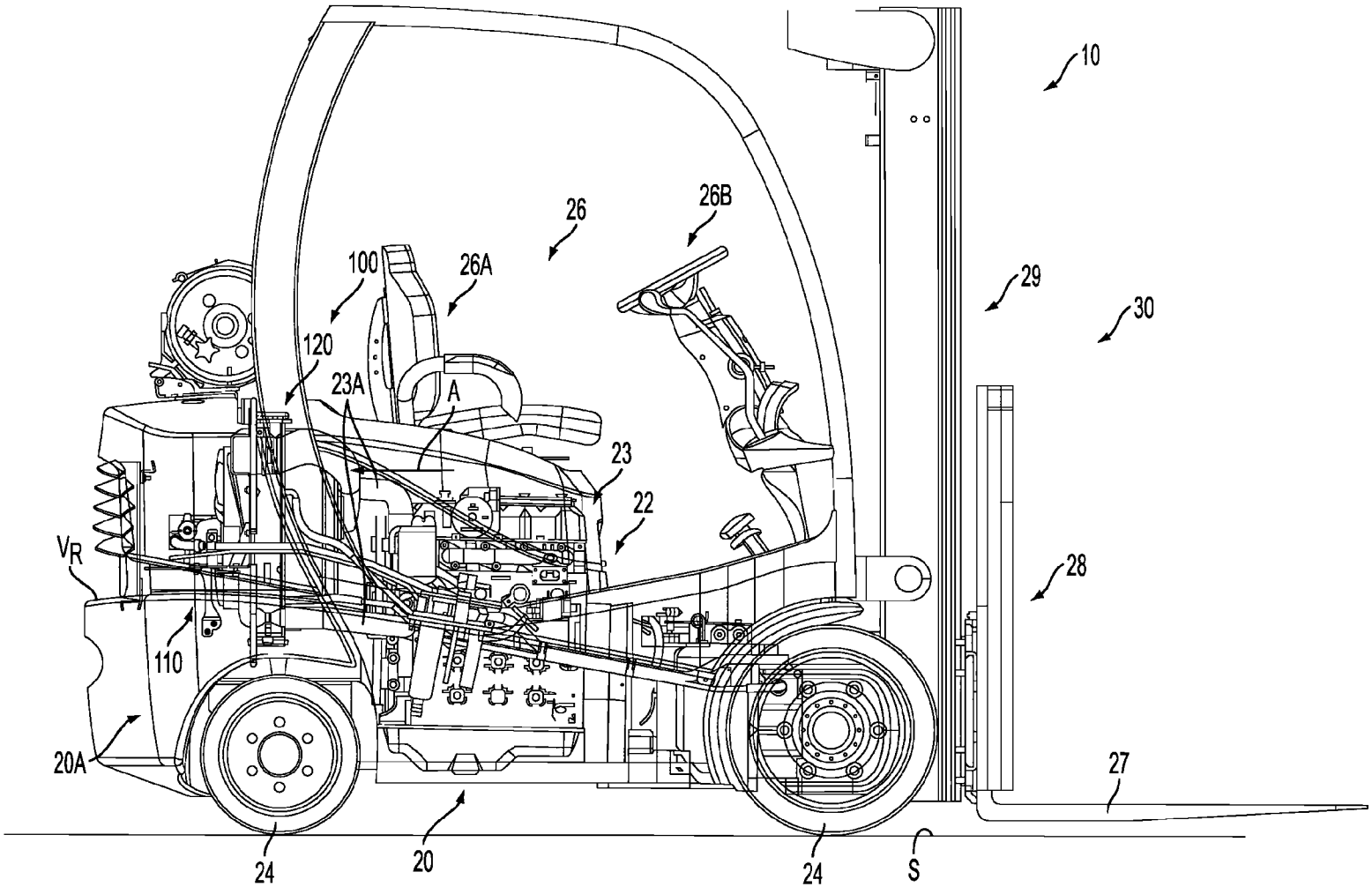
FIG. 1 is a side view of a vehicle including a cooling system constructed in accordance with the present invention.
Figure 2:
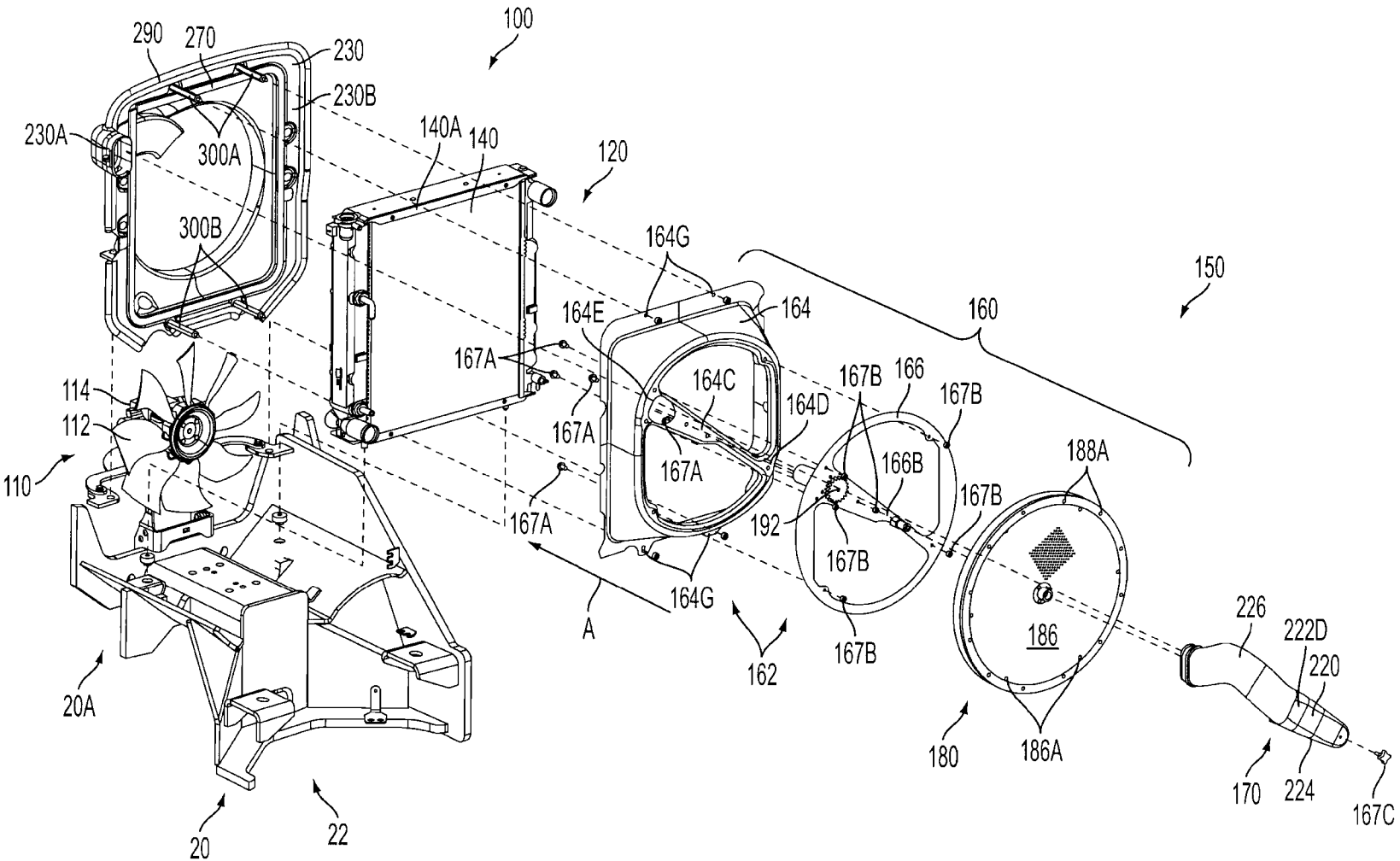
FIGS. 2 and 3 are exploded views including the cooling system illustrated in FIG. 1.

Referring now to the drawings, and particularly to FIG. 1, a work vehicle, comprising a materials handling vehicle 10 in the illustrated embodiment, is shown and includes a cooling system 100 constructed in accordance with the present invention, see also FIG. 2. The materials handling vehicle 10 comprises a main frame 20 including an engine compartment 22 housing an internal combustion engine 23 or a hybrid propulsion system (not shown). Four wheels 24 are coupled to the main frame 20. At least one of the wheels 24 is driven and at least one is steerable. The vehicle 10 also includes an operator's compartment 26 including an operator's seat 26A and a steering wheel 26B. A pair of forks 27 are mounted on a fork carriage mechanism 28, which, in turn, is coupled to an extensible mast assembly 29. The forks 27, fork carriage mechanism 28 and mast assembly 29 define a fork assembly 30 coupled to the main frame 20. As will be discussed further below, the cooling system 100 removes energy in the form of heat from the engine 23 and transfers that energy to air. It is contemplated that the cooling system 100 may also be incorporated into other work vehicles, such as a skid steer loader.

In the illustrated embodiment, the cooling system 100 comprises a rotating fan apparatus 110 and a cooling assembly 120, see FIG. 2. Both the fan apparatus 110 and the cooling assembly 120 are mounted to a rear portion 20A of the vehicle main frame 20, see FIGS. 1 and 2.

The fan apparatus 110 comprises a rotatable fan 112 and a motor 114. The motor 114 comprises a hydraulic motor in the illustrated embodiment, but may comprise an electric motor. During normal operation of the vehicle 10, the motor 114 effects rotation of the fan 112 in a first direction to pull air from inside the engine compartment 22, see direction arrow A in FIGS. 1 and 2, through the cooling assembly 120, then through an opening in the rear $V_R$ of the vehicle 10, see FIG. 1. As the air passes through the cooling assembly 120, it removes energy in the form of heat from a coolant fluid that circulates through the engine 23 and the cooling assembly 120. The speed of the motor 114 may vary with a temperature of the coolant fluid.

Figure 3:
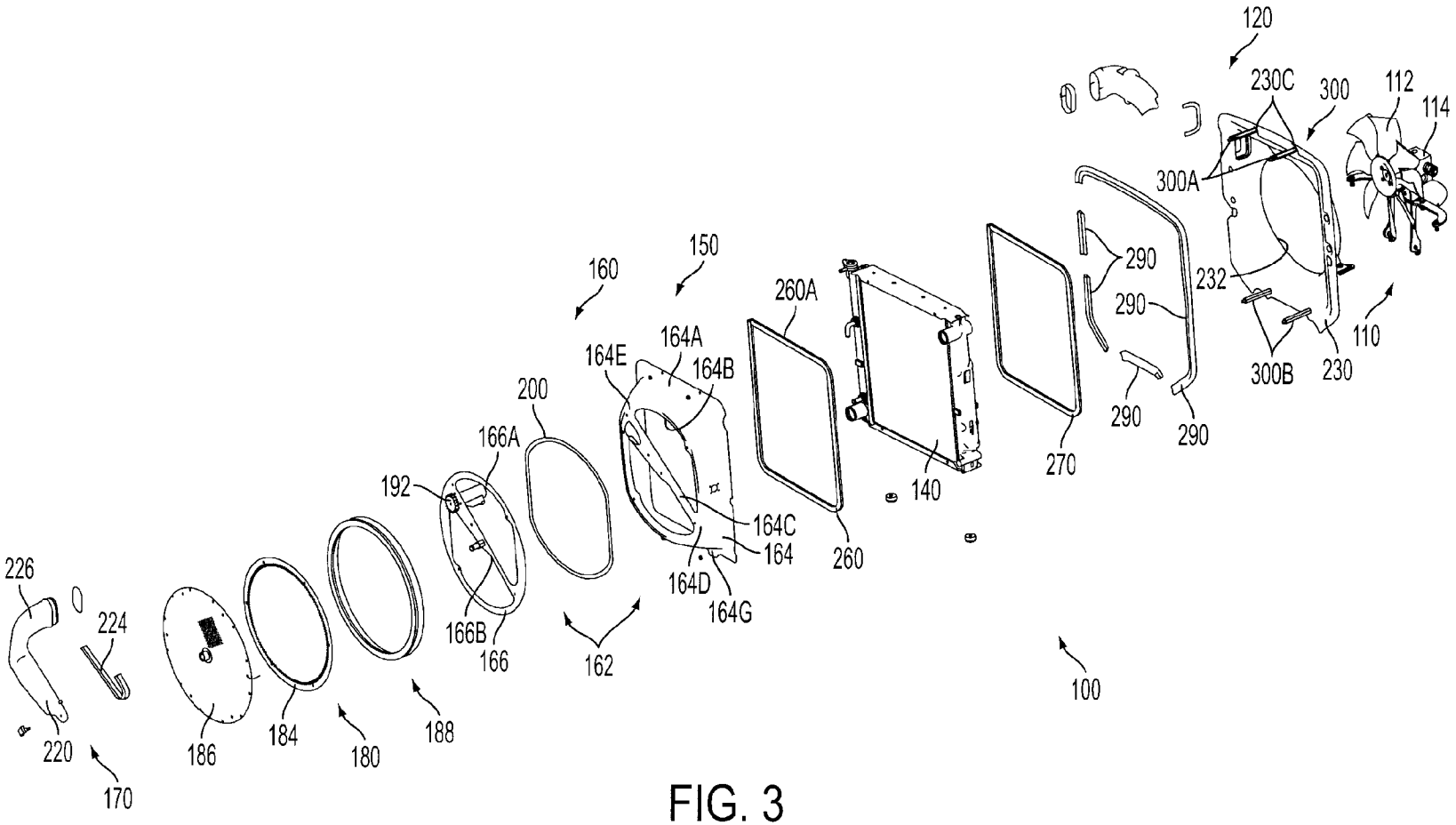

In the illustrated embodiment, the cooling assembly 120 comprises a heat exchanger 140, e.g., a radiator, and a filter apparatus 150, see FIG. 3. Appropriate hoses 23A, see FIG. 1, extend between the engine 23 and the heat exchanger 140 to allow the coolant fluid to flow between the engine 23 and the cooling assembly 120. The heat exchanger 140 transfers energy in the form of heat from the coolant fluid circulating through the engine 23 to air forced through the heat exchanger 140 by the fan apparatus 110.

In the illustrated embodiment, the filter apparatus 150 is positioned adjacent an engine-compartment side of the heat exchanger 140, see FIGS. 2 and 3. The filter apparatus 150 comprises filter structure 160 and a suction device 170 for removing debris from the filter structure 160. As will be discussed further below, the suction device 170 preferably expels the debris outside of the engine compartment 22. In this way, debris which might block the filter and reduce the effectiveness of the cooling system can be conveniently removed from the filter without interrupting the normal operation of the apparatus.

Figure 8:
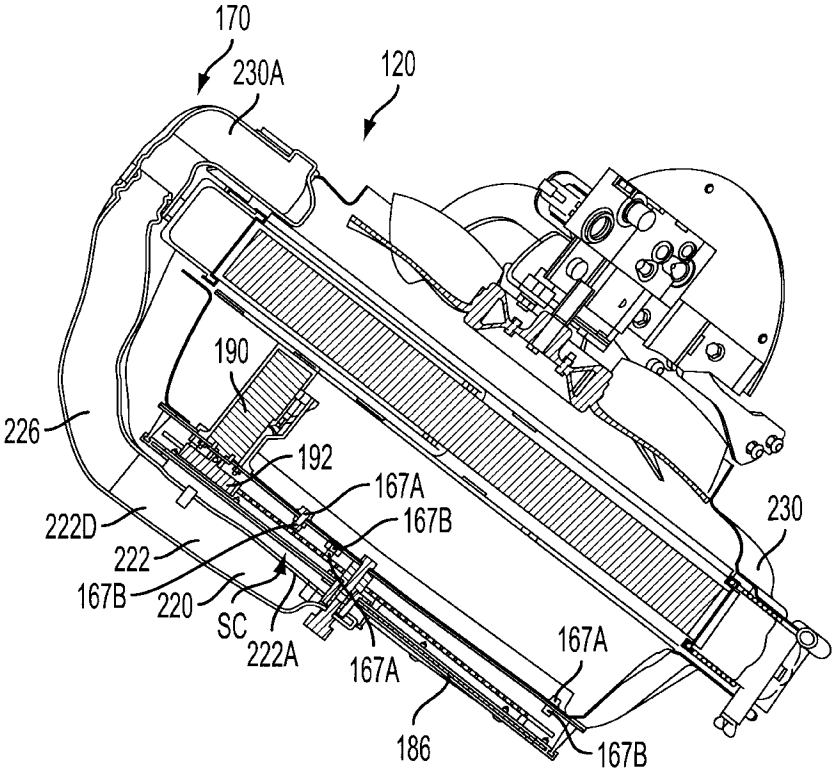
FIG. 8 is a view taken along section line 8-8 in FIG. 7.

In the illustrated embodiment, the filter structure 160 comprises a stationary support structure 162 and a rotatable filter element 180, see FIGS. 2 and 3. The stationary support structure 162 comprises a stationary inlet shroud 164 and a stationary mounting element 166. The inlet shroud 164 comprises an outer casing 164A having a central opening 164B and a support arm 164C extending across the opening 164B, see FIG. 3. The support arm 164C is coupled to, i.e., integral with, the outer casing 164A at two locations 164D and 164E. The stationary mounting element 166 comprises an outer ring portion 166A and a mounting arm 166B extending diametrically across and joined to, i.e., integral with, the ring portion 166A, see FIG. 3. In the illustrated embodiment, the stationary mounting element 166 is coupled to the inlet shroud 164 via six bolts 167A (only five are shown in FIG. 2), six nuts 167B and a thumb-screw 167C threaded into a shaft 210, see FIGS. 2, 6 and 8.

Figure 11:
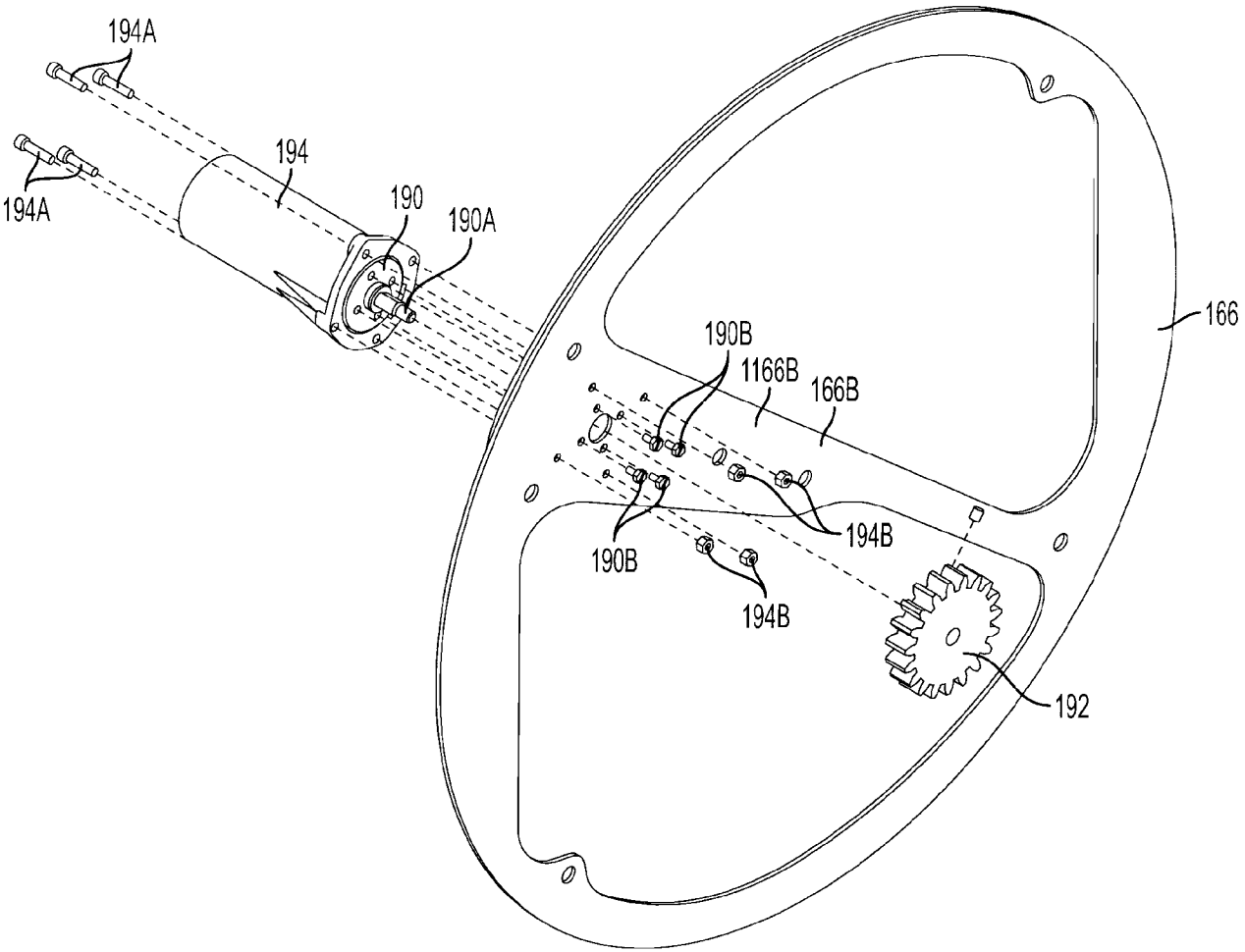
FIG. 11 is a perspective, exploded view of the mounting element, a motor and a pinion.

The filter structure 160 further comprises a motor 190 and a pinion or motor gear 192 coupled to a shaft 190A of the motor 190, see FIG. 11. Also provided is a cover 194 encasing and protecting the motor 190 from moisture, oil, and the like. The motor 190 is coupled to the mounting element 166 via bolts 190B and the cover 194 is coupled to the mounting element via bolts 194A and nuts 194B, see FIG. 11.

The support structure 162 further comprises a filter seal structure 200 located between the inlet shroud 164 and the mounting element 166, see FIG. 3. The filter seal structure 200 may be formed from any suitable material, such as a closed cell foam. The seal structure 200 may be held between the inlet shroud 164 and the mounting element 166 via friction or may be coupled to one or both of the inlet shroud 164 and the mounting element 166 via any convenient mechanism, such as a conventional adhesive. The filter seal structure 200 seals the mounting element 166 to the inlet shroud 164 so as to prevent air, dirt and debris from passing through an interface between the mounting element 166 and the inlet shroud 164.

Figure 5:
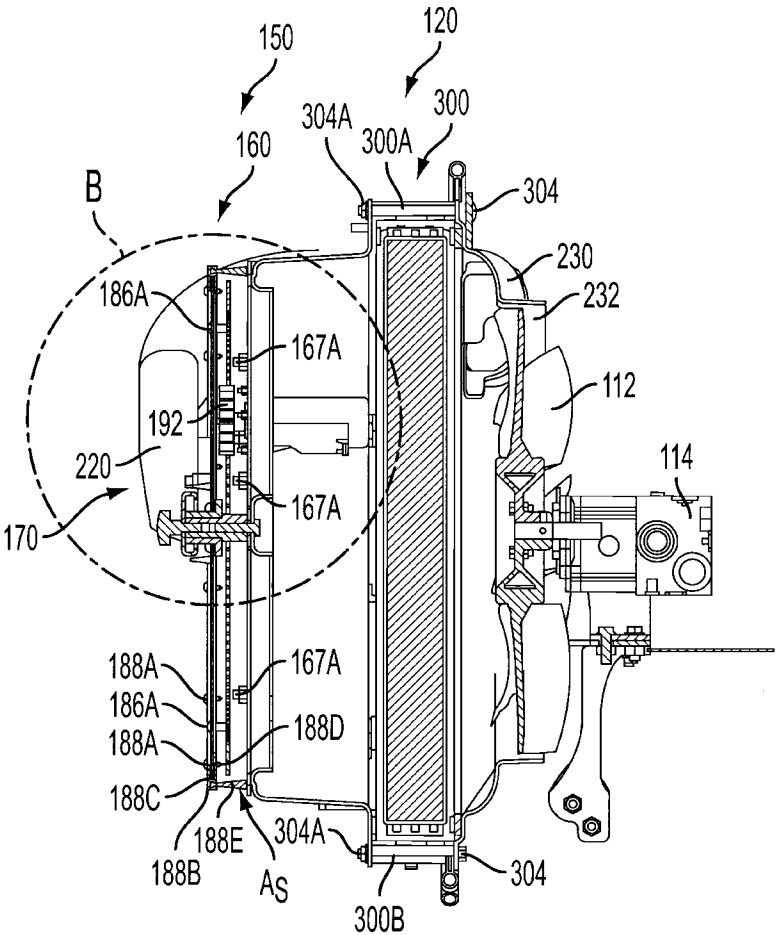
FIG. 5 is a view taken along section line 5-5 in FIG. 4.
Figure 6:
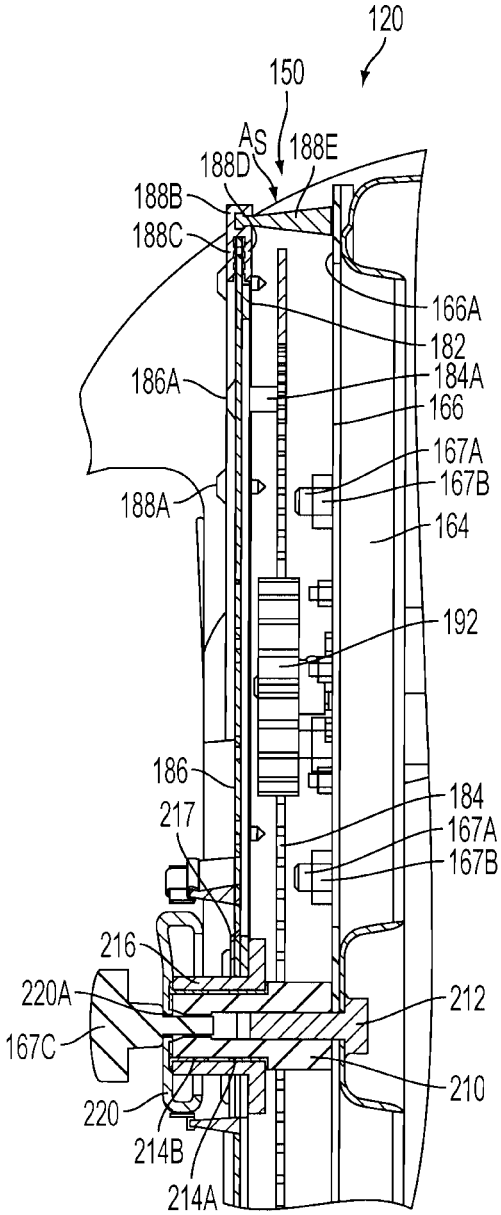
FIG. 6 is an enlarged sectional view of a portion of the cooling assembly illustrated in FIG. 5.
Figure 9:
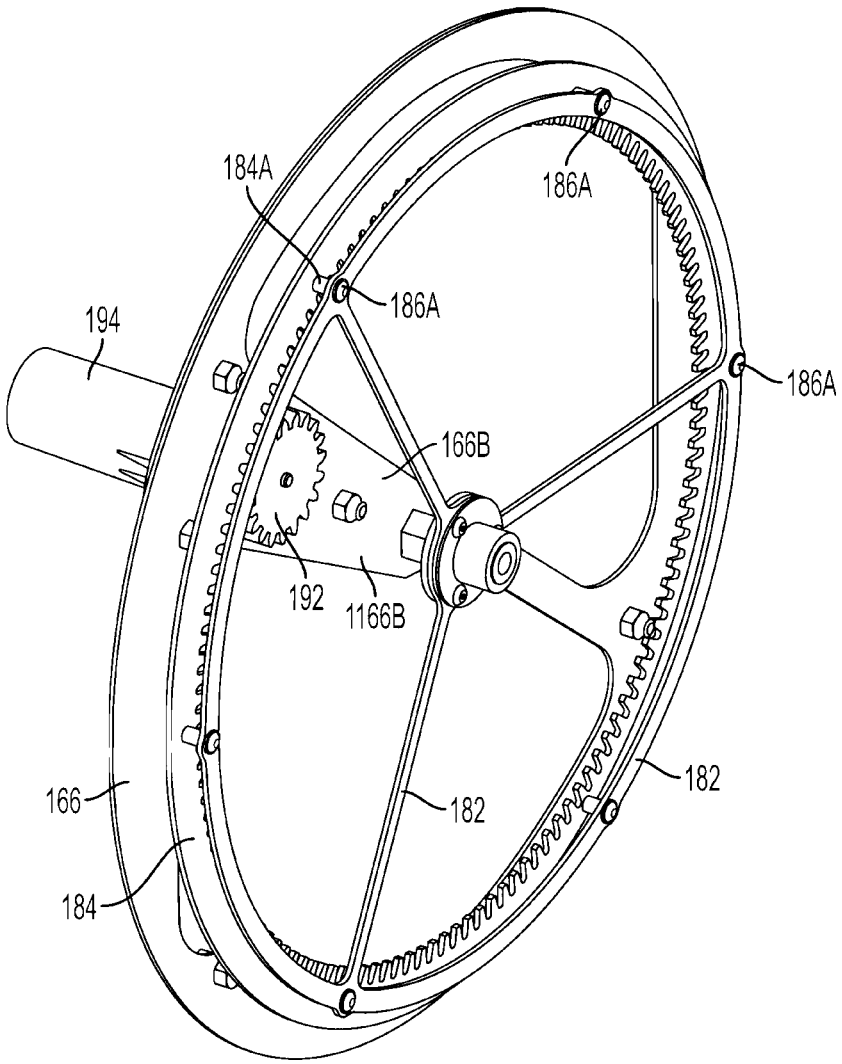
FIG. 9 is a perspective view of a mounting element, a spoked support frame and a ring gear, all forming part of a filter structure.
Figure 10:
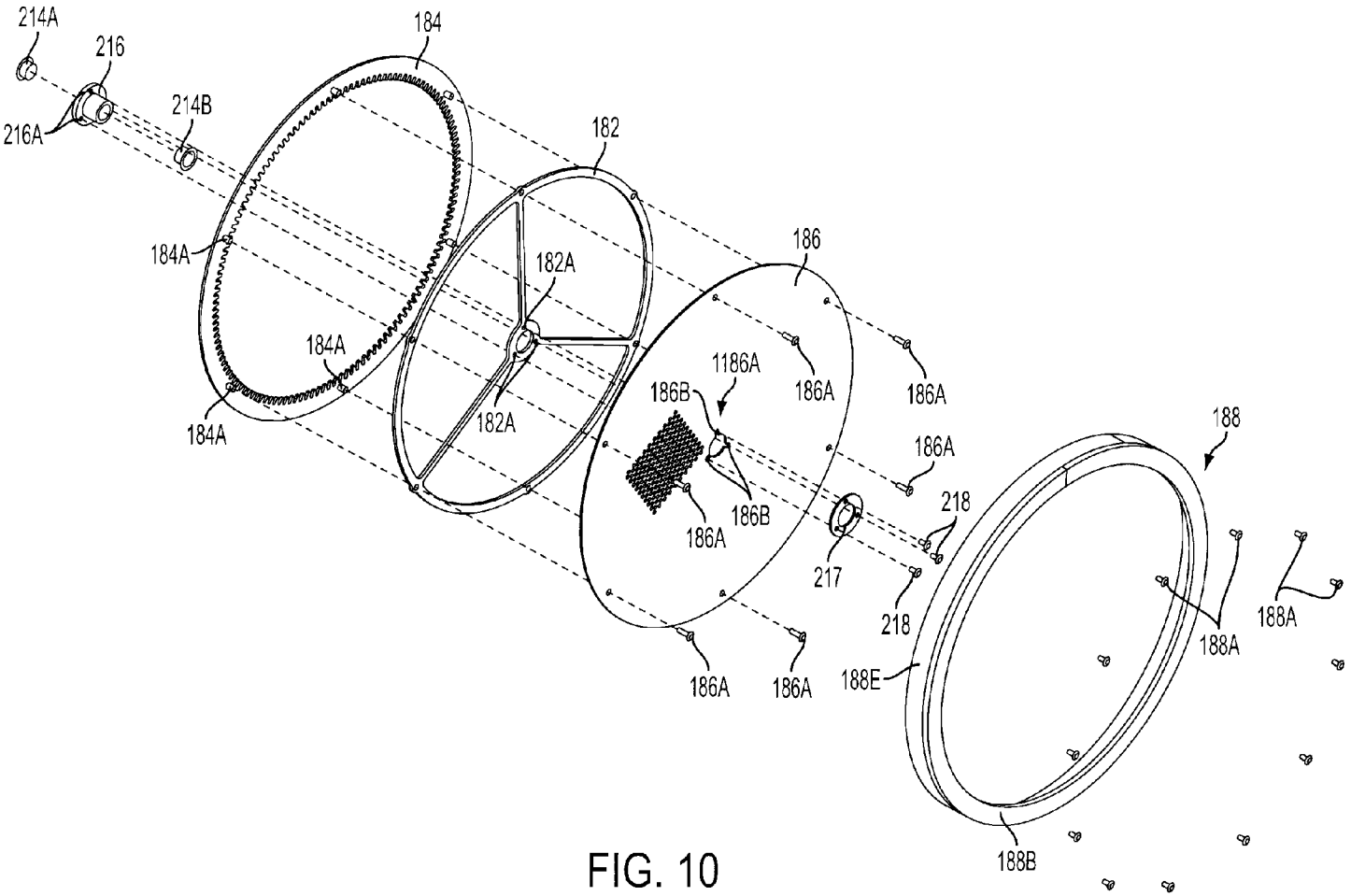
FIG. 10 is a perspective view of a rotatable filter element forming part of the filter structure.

The filter element 180 comprises a spoked support frame 182, a ring gear 184, a metal mesh screen 186 (not shown in FIG. 9), bolts 186A received in threaded spacers 184A on the ring gear 184 coupling the screen 186 and the spoked support frame 182 to the ring gear 184, and a brush seal assembly 188 coupled to the screen 186 via bolts 188A, see FIGS. 6, 9 and 10. The brush seal assembly 188 comprises a ring-shaped brush holder 188B having first and second arms 188C and 188D defining an inner recess for receiving the screen 186, see FIGS. 5 and 6. The bolts 188A extend through the first and second arms 188C and 188D and the screen 186 so as to couple the screen 186 to the brush holder 188B. A bristle brush 188E extends axially from the brush holder 188B and engages an outer surface 166A of the mounting element 166 so as to seal an area $A_s$ between the mounting element outer surface 166A and the spoked support frame 182 and the screen 186, see FIG. 6. It is noted that an outer diameter of the spoked support frame 182 is less than an inner diameter of the brush holder 188B. It is contemplated that the metal mesh screen 186 may be replaced by a filter media (not shown), a polymeric mesh screen (not shown), or a mesh screen (metal or polymeric) in combination with a filter media.

The shaft 210 is coupled to the inlet shroud 164 via a bolt 212, see FIG. 6. First and second bushings 214A and 214B and a rotatable hub 216, see FIGS. 6 and 10, are positioned over the shaft 210. The shaft 210 is not shown in FIG. 10. The first bushing 214A is first placed over the shaft 210, followed by the hub 216. The second bushing 214B is then placed over the hub 216. A washer 217, see FIG. 10, is positioned over a center section 1186A of the screen 186. Bolts 218 pass through the washer 217, corresponding slots 186B in the screen 186, bores 182A in the spoked support frame 182 and engage threaded bores 216A in the hub 216 so as to couple the screen 186 to the hub 216, see FIG. 10. An end of a suction arm 220 extends over the hub 216, see FIG. 6. The thumb-screw 167C passes through a bore 220A in the suction arm 220 and is received in a threaded bore in the shaft 210. The thumb-screw 167C and the suction arm 220 maintain the hub 216 on the shaft 210. The hub 216 together with the screen 186, the brush seal assembly 188, the spoked support frame 182 and the ring gear 184 are rotatable about the shaft 210.

The motor gear 192 engages the ring gear 184 such that rotation of the motor 190 effects rotation of the filter element 180.

Figure 4:
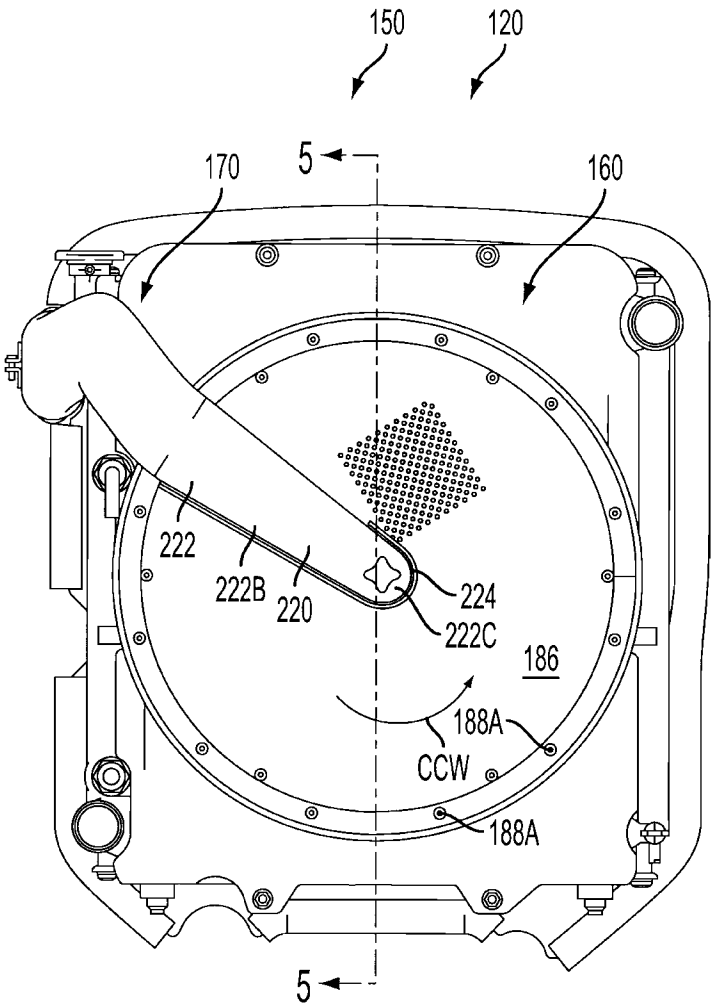
FIG. 4 is a front view of a cooling assembly forming part of the cooling system illustrated in FIG. 1.
Figure 12:
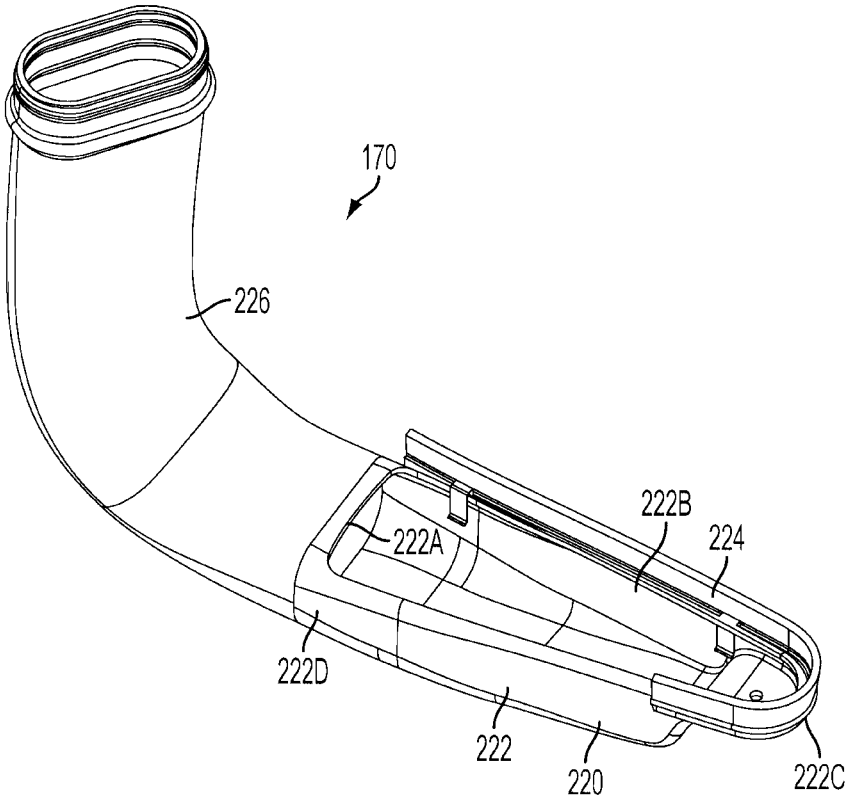
FIG. 12 is a perspective view of a vacuum arm.

As noted above, the suction device 170 removes debris from the filter structure 160. The suction device 170 comprises the suction arm 220, which is positioned adjacent the screen 186, see FIGS. 4, 7 and 8. The suction arm 220 comprises a polymeric tube-like structure 222 having an opening 222A, see FIGS. 8 and 12, which faces the screen 186. A brush 224 is coupled to a lower surface 222B of the tube-like structure 222 and extends around a first end 222C of the tube-like structure 222. The brush 224 engages the screen 186 as the filter element 180 is rotated by the motor 190 so as to brush debris, dirt and the like upward towards the opening 222A in the tube-like structure 222. The brush 224 further direct debris that otherwise might exit at the first end 222C of the tube-like structure 222 inward toward the opening 222A. The filter element 180 rotates in a counter-clock wise direction, as indicated by arrow CCW in FIG. 4. The motor 190 may be actuated to effect rotation of the filter element 180 continuously or intermittently. In the illustrated embodiment, the motor 190 is actuated to effect rotation of the filter element 180 when the vehicle 10 is first started and once about every twenty minutes of vehicle operation for about 30 seconds.

Figure 7:
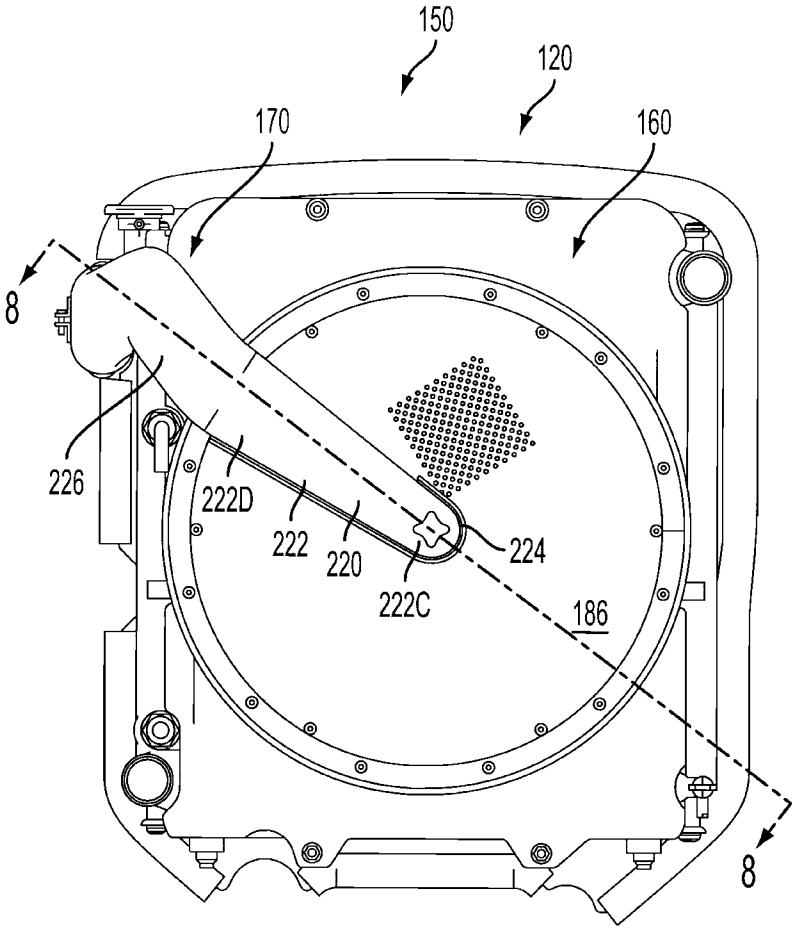
FIG. 7 is a front view of the cooling assembly forming part of the cooling system illustrated in FIG. 1.

The suction device 170 further comprises a suction duct 226 that is coupled to an outer, second end 222D of the tube-like structure 222, see FIGS. 2 and 7. The suction duct 226 is further coupled to an inlet 230A of a fan shroud 230 positioned adjacent a side of the heat exchanger 140 opposite the engine-compartment side, see FIGS. 2 and 8. The fan 112 extends into a central opening 232 in the fan shroud 230, see FIG. 5. As the fan 112 rotates, it draws air through the suction duct 226 and the suction arm 220 creating a suction force at the opening 222A in the suction arm 220. A portion 1166B of the mounting arm 166B, see FIGS. 8, 9 and 11, of the stationary mounting element 166 is located directly across from the suction arm 220 and spaced a small distance away from the suction arm 220. The filter element 180 is positioned between the suction arm 220 and the mounting arm portion 1166B. The mounting arm portion 1166B and the suction arm 220 define a suction chamber SC through which the filter element 180 passes as the filter element 180 is rotated. The mounting arm portion 1166B has a shape similar to that of the suction arm 220 so as to reduce the air flow path into the suction arm opening 222A, thereby increasing a suction force in the suction chamber SC created by the suction force at the suction arm opening 222A. As the filter element 180 moves through the suction chamber SC, debris is pulled/removed from the screen 186 via the suction force in the suction chamber SC and moved through the suction arm 220, the suction duct 226 and the fan shroud 230, and exits the vehicle 10 through the opening in the rear $V_R$ of the vehicle 10. Hence, the debris removed from the screen 186 is not deposited into the engine compartment 22, but, instead, is deposited outside of the vehicle 10.

The cooling assembly 120 further comprises a first seal structure 260 and a second seal structure 270, see FIG. 3. The first seal structure 260 may comprise a seal strip 260A formed from a closed cell foam. The seal strip 260A is positioned between peripheral surfaces 164F and 140A of the inlet shroud 164 and the heat exchanger 140, respectively, to seal an interface between the inlet shroud 164 and the heat exchanger 140, see FIGS. 2, 13 and 14. The seal strip 260A may be frictionally held between the inlet shroud 164 and the heat exchanger 140 or adhesively secured to one or both of the inlet shroud 164 and the heat exchanger 140.

The second seal structure 270 may comprise a seal strip 270A formed from a closed cell foam, although other suitable materials may also be used. The seal strip 270A is positioned between peripheral surfaces 140B and 230B of the heat exchanger 140 and the fan shroud 230, respectively, to seal an interface between the heat exchanger 140 and the fan shroud 230, see FIGS. 13 and 14. The seal strip 270A may be frictionally held between the heat exchanger 140 and the fan shroud 230 or adhesively secured to one or both of the heat exchanger 140 and the fan shroud 230.

Figure 13:
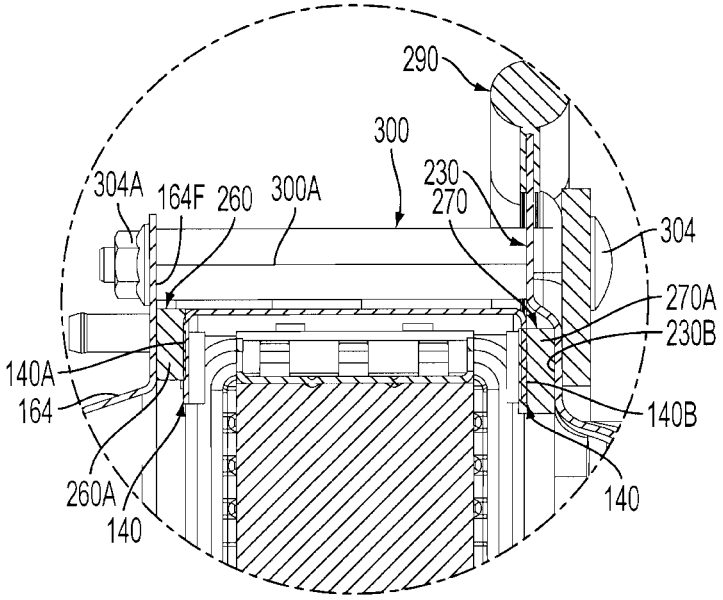
FIG. 13 is a cross sectional view of an upper portion of the cooling assembly.
Figure 14:
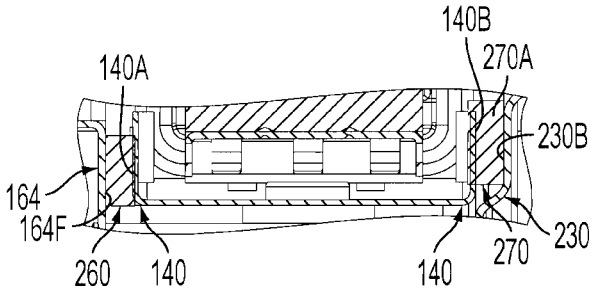
FIG. 14 is a cross sectional view of a lower portion of the cooling assembly.

The cooling assembly 120 also comprises connecting structure 300 to couple together the filter apparatus 150, the first and second seal structures 260 and 270, the heat exchanger 140 and the fan shroud 230, see FIGS. 3, 5 and 13. In the illustrated embodiment, the connecting structure 300 comprises first and second upper spacers 300A, first and second lower spacers 300B and corresponding bolts 304 that pass through bores in the spacers 300A and 300B, see FIGS. 5 and 13. The bolts 304 also extend through corresponding bores or recesses 164G and 230C in the inlet shroud 164 and the fan shroud 230, see FIGS. 2 and 3. The spacers 300A and 300B are located between the inlet shroud 164 and the fan shroud 230, see FIG. 13. Corresponding nuts 304A engage with the bolts 304 such that the connecting structure 300 secures the filter apparatus 150, the first and second seal structures 260 and 270, the heat exchanger 140 and the fan shroud 230 together as a single assembly 120. The cooling assembly 120 may be assembled outside of the vehicle main frame 20 and, once assembled, then installed into the vehicle main frame 20.

The cooling assembly 120 may still further comprise a main frame seal structure 290, see FIGS. 2 and 3, located between the fan shroud 230 and the vehicle main frame 20. The main frame seal structure 290 may comprise a plurality of seal strips 290A formed from ethylene propylene diene M-class rubber (EPDM) bulb edge seal, which is commercially available from PPR Industries. The seal strips 290A are positioned between the outer periphery 230B of the fan shroud 230 and an engagement surface (not shown) on the vehicle main frame 20 to seal an interface between the fan shroud 230 and the vehicle main frame engagement surface. The seal strips 290A may be frictionally held between the fan shroud 230 and the vehicle main frame engagement surface or adhesively secured to one or both of the fan shroud 230 and the vehicle main frame engagement surface. The seal strips 290A prevent air being expelled by the fan 112 from passing back into the engine compartment 22 between the fan shroud 230 and the vehicle main frame 20 and then, once again, through the heat exchanger 140. Heated air re-circulated through the heat exchanger 140 reduces the efficiency of the heat exchanger 140.

Having described the invention in detail and by reference to preferred embodiments thereof, it will be apparent that modifications and variations are possible without departing from the scope of the invention defined in the appended claims.

What is claimed is:

1. A work vehicle comprising:

a main frame including an engine compartment;

an engine located in said engine compartment; and a cooling system comprising a rotating fan apparatus and a cooling assembly, said cooling assembly comprising:

a heat exchanger for transferring energy in the form of heat from a coolant fluid to air, wherein the air is moved through said heat exchanger by said fan apparatus; and filter apparatus positioned adjacent an engine-compartment side of said heat exchanger to filter the air before the air passes through said heat exchanger, said filter apparatus comprising filter structure and a suction device for removing debris from said filter structure, wherein said suction device expels said debris outside of said engine compartment.

2. The work vehicle as set out in claim 1, wherein said filter structure comprises a support structure and a filter element.

3. The work vehicle as set out in claim 2, wherein said support structure comprises an inlet shroud and a mounting element coupled to said inlet shroud.

4. The work vehicle as set out in claim 3, wherein said filter structure further comprises a motor coupled to said mounting element and a motor gear coupled to said motor, and said filter element comprises a screen mounted to said mounting element and a ring gear associated with said screen, said motor gear engaging said ring gear such that rotation of said motor effects rotation of said filter element.

5. The work vehicle as set out in claim 4, wherein said suction device comprises a suction arm positioned adjacent said screen and a suction duct communicating with said suction arm and a fan shroud positioned adjacent a side of said heat exchanger opposite said engine-compartment side, wherein said fan apparatus draws air through said suction duct and said suction arm such that debris is removed from said screen and moved through said suction arm and said suction duct into said fan shroud so as to be deposited outside of said engine compartment.

6. The work vehicle as set out in claim 3, wherein said cooling assembly further comprises:

a fan shroud positioned adjacent a side of said heat exchanger opposite said engine-compartment side; and connecting structure to couple said inlet shroud and said fan shroud together with said heat exchanger positioned between said inlet shroud and said fan shroud.

7. The work vehicle as set out in claim 6, wherein said cooling assembly further comprises a first seal structure located between said heat exchanger and said inlet shroud so as to seal an interface between said heat exchanger and said inlet shroud.

8. The work vehicle as set out in claim 7, wherein said cooling assembly further comprises a second seal structure located between said heat exchanger and said fan shroud so as to seal an interface between said heat exchanger and said fan shroud.

9. The work vehicle as set out in claim 3, wherein said support structure further comprises a filter seal structure located between said inlet shroud and said mounting element so as to seal an interface between said inlet shroud and said mounting element.

10. The work vehicle as set out in claim 4, wherein said filter element further comprises a brush seal located along an outer periphery of said screen so as to seal an interface between said screen and said mounting element.

11. A cooling assembly for use in a work vehicle comprising:

a heat exchanger for transferring energy in the form of heat from a coolant fluid to air passing through said heat exchanger;

filter apparatus positioned adjacent a first side of said heat exchanger to filter the air before the air passes through said heat exchanger, said filter apparatus comprising filter structure and a suction device for removing debris from said filter structure;

a fan shroud positioned adjacent a second side of said heat exchanger opposite said first side; and connecting structure to couple said filter structure and said fan shroud together with said heat exchanger positioned between said filter structure and said fan shroud, thereby forming a cooling assembly capable of being subsequently mounted into a work vehicle.

12. The cooling assembly as set out in claim 11, wherein said filter structure comprises a support structure and a filter element.

13. The cooling assembly as set out in claim 12, wherein said support structure comprises an inlet shroud and a mounting element coupled to said inlet shroud.

14. The cooling assembly as set out in claim 13, wherein said filter structure further comprises a motor coupled to said mounting element and a motor gear coupled to said motor, and said filter element comprises a screen mounted to said mounting element and a ring gear associated with said screen, said motor gear engaging said ring gear such that rotation of said motor effects rotation of said filter element.

15. The cooling assembly as set out in claim 14, wherein said suction device comprises a suction arm positioned adjacent said screen and a suction duct communicating with said suction arm and said fan shroud, wherein a fan apparatus draws air through said suction duct and said suction arm such that debris is removed from said screen and moved through said suction arm and said suction duct into said fan shroud.

16. The cooling assembly as set out in claim 13, wherein said cooling assembly further comprises a first seal structure located between said heat exchanger and said inlet shroud so as to seal an interface between said heat exchanger and said inlet shroud.

17. The cooling assembly as set out in claim 16, wherein said cooling assembly further comprises a second seal structure located between said heat exchanger and said fan shroud so as to seal an interface between said heat exchanger and said fan shroud.

18. The cooling assembly as set out in claim 13, wherein said support structure further comprises a filter seal structure located between said inlet shroud and said mounting element so as to seal an interface between said inlet shroud and said mounting element.

19. The cooling assembly as set out in claim 14, wherein said filter element further comprises a brush seal located along an outer periphery of said screen so as to seal an interface between said screen and said mounting element.

* * * * *